US008136903B2

(12) United States Patent
Kunihiro

(10) Patent No.: US 8,136,903 B2
(45) Date of Patent: Mar. 20, 2012

(54) INK JET PRINTING APPARATUS AND INK JET PRINTING METHOD

(75) Inventor: Syunichi Kunihiro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 419 days.

(21) Appl. No.: 12/512,138

(22) Filed: Jul. 30, 2009

(65) Prior Publication Data

US 2010/0033525 A1 Feb. 11, 2010

(30) Foreign Application Priority Data

Aug. 8, 2008 (JP) ..... 2008-206192

(51) Int. Cl.
*B41J 29/38* (2006.01)

(52) U.S. Cl. ..... 347/12; 347/5; 347/9; 347/14; 347/16

(58) Field of Classification Search ..... None
See application file for complete search history.

(56) References Cited

FOREIGN PATENT DOCUMENTS

JP 11-170501 6/1999

*Primary Examiner* — Matthew Luu
*Assistant Examiner* — Justin Seo
(74) *Attorney, Agent, or Firm* — Fitzpatrick, Cella, Harper & Scinto

(57) ABSTRACT

In an ink jet printing apparatus including a plurality of nozzle arrays, if a print position displacement between the nozzle arrays is adjusted, it is possible to perform high-speed printing at the time of performing a printing operation using only a single nozzle array. Specially at the time of changing a printing state of using a first nozzle array and a second nozzle array into a printing state of using the first nozzle array only, a conveying amount of the printing medium is changed in accordance with the displacement of the printing medium.

11 Claims, 9 Drawing Sheets

INK JET PRINTING APPARATUS AND INK JET PRINTING METHOD

BACKGROUND OF THE INVENTION

1. Field of the Invention

The present invention relates to an ink jet printing apparatus and an ink jet printing method which perform a printing operation using a print head for ejecting ink. In particular, the present invention relates to a structure for correcting relative print position displacement between a plurality of nozzle arrays.

2. Description of the Related Art

In an ink jet printing apparatus, a displacement is caused in a printing position between a plurality of nozzle arrays provided in a print head due to an error in the manufacture or the like, so that unevenness of density or stripes may appear in a printed image. Japanese Patent Laid-Open No. H11-170501 (1999) describes a technology of adjusting a relative print position displacement between a plurality of nozzle arrays in a conveying direction (sub-scanning direction) of a printing medium. More specifically, Japanese Patent Laid-Open No. H11-170501 (1999) describes the structure for adjusting the displacement of the printing positions in the sub-scanning direction by changing a range of nozzles used in each nozzle array.

As one form of the ink jet printing apparatus, there is known a printing apparatus of using a print head provided with a nozzle array which has a short nozzle arrangement length and ejects color ink such as cyan, magenta and yellow inks, and a black nozzle array which has a longer nozzle arrangement length than that of the above nozzle array. Use of such a print head enables, for example, a problem with ink bleeding in a printing medium such as a print paper to be reduced and also an image in a single black color to be printed at high speeds.

For example, in a case of printing an image using both black ink and color ink, the black nozzle array having the longer nozzle arrangement length is configured to use only a part of the nozzles, and the black ink and the color ink which should be applied to the same area on the printing medium are configured to be ejected by different scans. In consequence, since the black ink and the color ink are applied to the same area with each other by an interval of a fixing time corresponding to approximately one time of scanning, the inks bleed into each other between the black ink and the color ink can be restricted. In a case of printing an image using only the black ink, use of only the black nozzle array having the long nozzle arrangement length allows a printing area corresponding to one time of scanning of the print head to be increased and therefore, the high-speed printing of the image in the single black color can be realized.

However, in a case of printing an image in which an area using both of black ink and color ink and an area using only black ink exist in a mixed manner, when the structure of adjusting the print position displacement between the nozzle arrays as described above is applied as it is, in a case of printing an image of the area using only the black ink, the high-speed printing of the image by the longer nozzle arrangement length may not be realized. More specifically, an adjustment value for adjusting a relative printing position between a plurality of nozzle arrays is applied also to a case of performing a printing operation using only a single nozzle array. Therefore, the above adjustment can prevent the print position displacement possibly caused between the area subjected to printing using both of the black ink and the color ink and the area subjected to printing using only the black ink, and it is also possible to perform the printing with the print position displacement between the plurality of the nozzle arrays being removed in any of the areas. However, in a case of performing the printing using only the single nozzle array, not all of the nozzles in that nozzle array can be used because of the adjustment of the print position displacement. As a result, the high-speed printing of the image by the longer nozzle arrangement length may not be realized.

For example, when adjusting a print position displacement in a sub-scanning direction between the part of the black nozzle array and the color nozzle array, in order to perform a printing operation using a part of the black nozzle array having the longer nozzle arrangement length and using the color nozzle having the short nozzle arrangement length, a use range of the black nozzle array changes in accordance with the print position displacement. Then, in a case of printing an area of the image of a single black color, only nozzles in the use range changing with an adjustment value of the printing position adjustment among the black nozzle array can be used, and therefore, the high-speed printing of the image using all the nozzles in the black nozzle array can not be sufficiently realized.

SUMMARY OF THE INVENTION

An object of the present invention is to provide an ink jet printing apparatus and an ink jet printing method which can sufficiently perform high-speed printing at the time of performing a printing operation using only a single nozzle array even if a print position displacement between a plurality of nozzle arrays is adjusted.

In a first aspect of the present invention, there is provided a printing apparatus comprising: a printing unit having a first nozzle array and a second nozzle array which respectively arrange a plurality of nozzles in a predetermined direction; a conveying unit for conveying a print medium in the predetermined direction; and a control unit for controlling the printing unit and the conveying unit to print an image on the print medium, wherein the control unit is capable of performing a first mode that makes the first nozzle array be used for printing of the first nozzle array and the second nozzle array and a second mode that makes the first and second nozzle arrays be used for printing, and the control unit changes use nozzles in the first nozzle array in accordance with a relative print position displacement in the predetermined direction between the first and second nozzle arrays when performing the second mode, and changes a conveying amount of the print medium, which conveyance is performed between the first mode and the second mode, in accordance with the relative print position displacement.

In a second aspect of the present invention, there is provided a printing method comprising: a printing step of controlling a printing unit having a first nozzle array and a second nozzle array which respectively arrange a plurality of nozzles in a predetermined direction and a conveying unit for conveying a print medium in the predetermined direction to print an image on the print medium, wherein the printing step is capable of performing a first mode that makes the first nozzle array be used for printing of the first nozzle array and the second nozzle array and a second mode that makes the first and second nozzle arrays be used for printing, and the printing step changes use nozzles in the first nozzle array in accordance with a relative print position displacement in the predetermined direction between the first and second nozzle arrays when performing the second mode, and changes a conveying amount of the print medium, which conveyance is performed between the first mode and the second mode, in accordance with the relative print position displacement.

According to the above structure, in the printing apparatus provided with the print head having the plurality of the nozzle arrays, high-speed printing can be realized in a case of switching between a mode of using a nozzle array alone as an object of printing position adjustment and a mode of using another nozzle array together with the nozzle array.

Further features of the present invention will become apparent form the following description of exemplary embodiments (with reference to the attached drawings).

DESCRIPTION OF THE EMBODIMENTS

In the present specification, "printing" means not only a case of forming meaningful information such as characters or figures but also a case of, regardless of meaningful or non-meaningful information, widely forming an image, a design, a pattern, and the like on a printing medium or processing the printing medium. Further, "printing" does not require a condition on whether or not the printing is so obvious as to be visually perceived by persons.

"printing medium" includes not only a paper used in a general printing apparatus, but also widely a medium capable of receiving ink, such as cloth, plastic film, metallic plate, glass, ceramic, lumber, or leather.

Further, "ink" should be interpreted widely in the same way as the definition of the above "printing" and is a liquid which is applied on a printing medium to be used for forming an image, a design, a pattern and the like or processing the printing medium, or is used for processing ink. The processing of the ink includes coagulating or insolubilizing a color material in the ink applied on the printing medium, for example.

Furthermore, "nozzle" (possibly called also "printing element") means, unless particularly stated, collectively an ejection opening, a liquid passage communicated with the ejection opening, and an element generating energy used for ink ejection.

Figure 1:
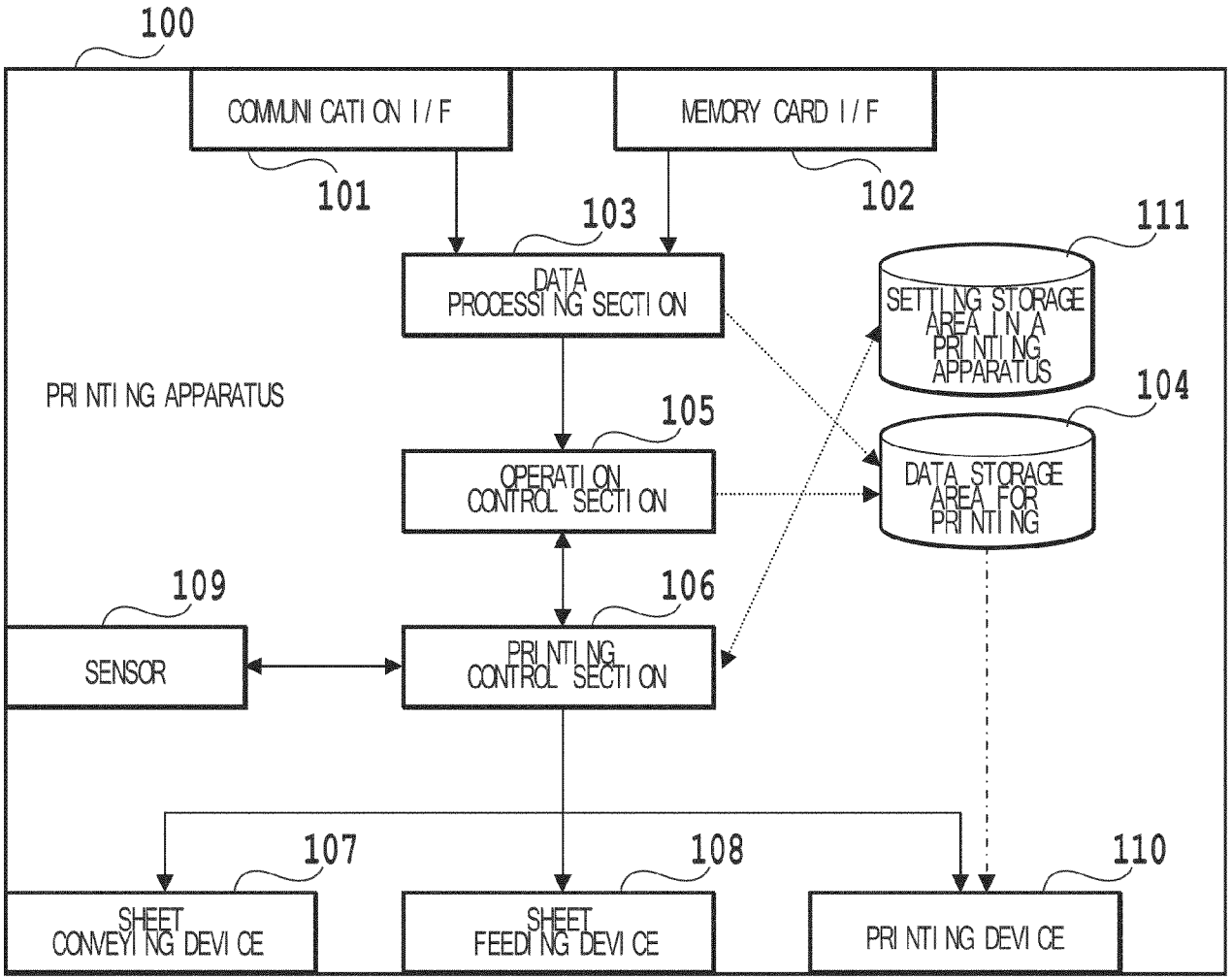
FIG. 1 is a diagram showing a construction of a printing apparatus according to an embodiment of the present invention.

FIG. 1 is a block diagram showing a structure of an ink jet printing apparatus (hereinafter, simply referred to as printing apparatus also) according to an embodiment of the present invention.

A printing apparatus 100 is provided with an external interface (I/F) 101 for communicating to obtain print data from an external unit and a memory card interface (I/F) 102 for obtaining data from an external storage represented by a memory card. The data obtained from any of I/F 101 and I/F 102 is analyzed by a data processing section 103, and the analyzed data is accumulated in a data storage area 104 for printing and is also transmitted to a control section 105. The control section 105 instructs a command of a printing operation to a printing control section (also called as simply "control section") 106, which controls each device in the printing apparatus, for performing sequence of the printing operation. The printing control section 106 instructs a command to a sheet conveying device 107 for controlling a conveying roller and to a sheet feeding device 108 for controlling a sheet discharging roller based upon the command of the printing operation, so as to convey a sheet. During sheet conveying, a sensor 109 is used to confirm a conveying condition of the sheet. Thus, in this embodiment, the conveying roller, the sheet conveying device 107 for controlling the conveying roller, the sheet discharging roller, and the sheet feeding device 108 for controlling the sheet discharging roller correspond to a conveying section conveying a print medium in a predetermined direction (sub-scanning direction). The printing control section 106 controls a printing device 110 as a printing section to perform the printing operation. This printing operation includes, for example, control in relation to an adjustment of a print position displacement between a plurality of nozzle arrays to be described later.

In addition, the sensor 109 functions as an optical measuring device and can detect density (optical characteristic) of a test pattern for adjusting a displacement in a printing position by the nozzle arrays. The density information read by the sensor 109 is stored and memorized in a printing apparatus setting storage area 111 as an adjustment value for adjusting the displacement in the printing position between the nozzle arrays.

Figure 2:
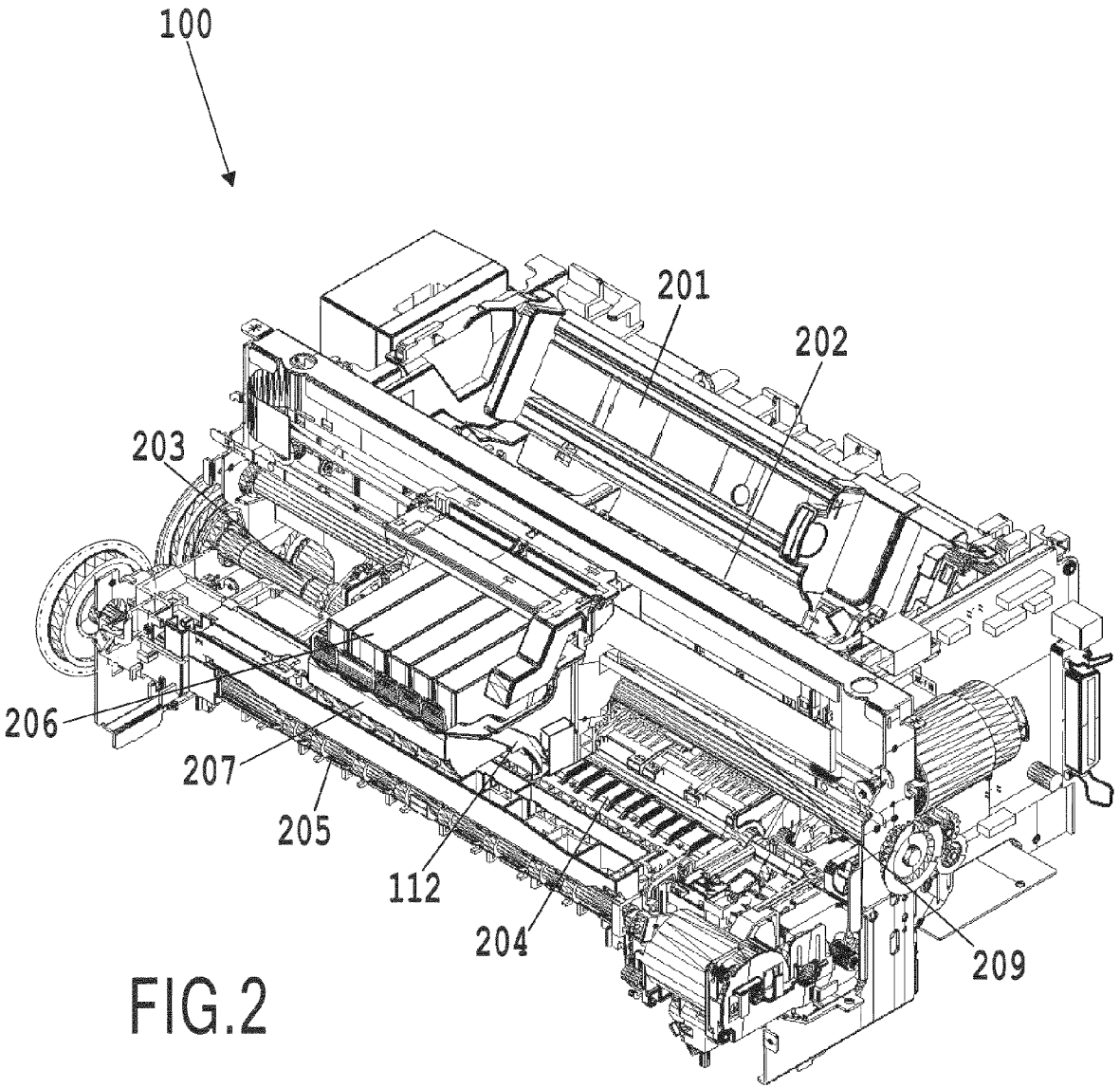
FIG. 2 is a perspective view showing a mechanism unit of the printing apparatus according to the embodiment of the present invention.

FIG. 2 is a perspective view showing a mechanism unit of the printing apparatus including the sheet conveying device, the sheet feeding device, the printing device and the like shown in FIG. 1.

The printing apparatus 100 is provided with a print medium feeding and setting portion 201 for setting a printing medium such as a print paper, and the set printing medium is fed through a sheet feeding opening 202 into the printing apparatus 100. The printing medium fed into the printing apparatus 100 is conveyed on a printing platen 204 by a conveying roller 203 and is discharged through a sheet discharging roller 205 to an outside of the printing apparatus.

The printing apparatus is therein provided with a carriage unit 207 which can set a plurality of ink cartridges 206 and print heads 112 for ejecting ink supplied from the set ink cartridges 206 onto the printing medium. Further, the carriage unit 207 is so configured as to be movable in a main-scanning direction on a carriage guide unit 209. This allows the print heads 110 to scan the printing medium, which is conveyed on the printing platen 204, in the main-scanning direction to perform a printing operation. Thus, the above described printing device 110 is made up with the print head 112 and the carriage unit 207. The carriage unit 207 mounts the sensor 109 (not shown in FIG. 2) which is provided for reading the density of the printed test pattern.

Figure 3:
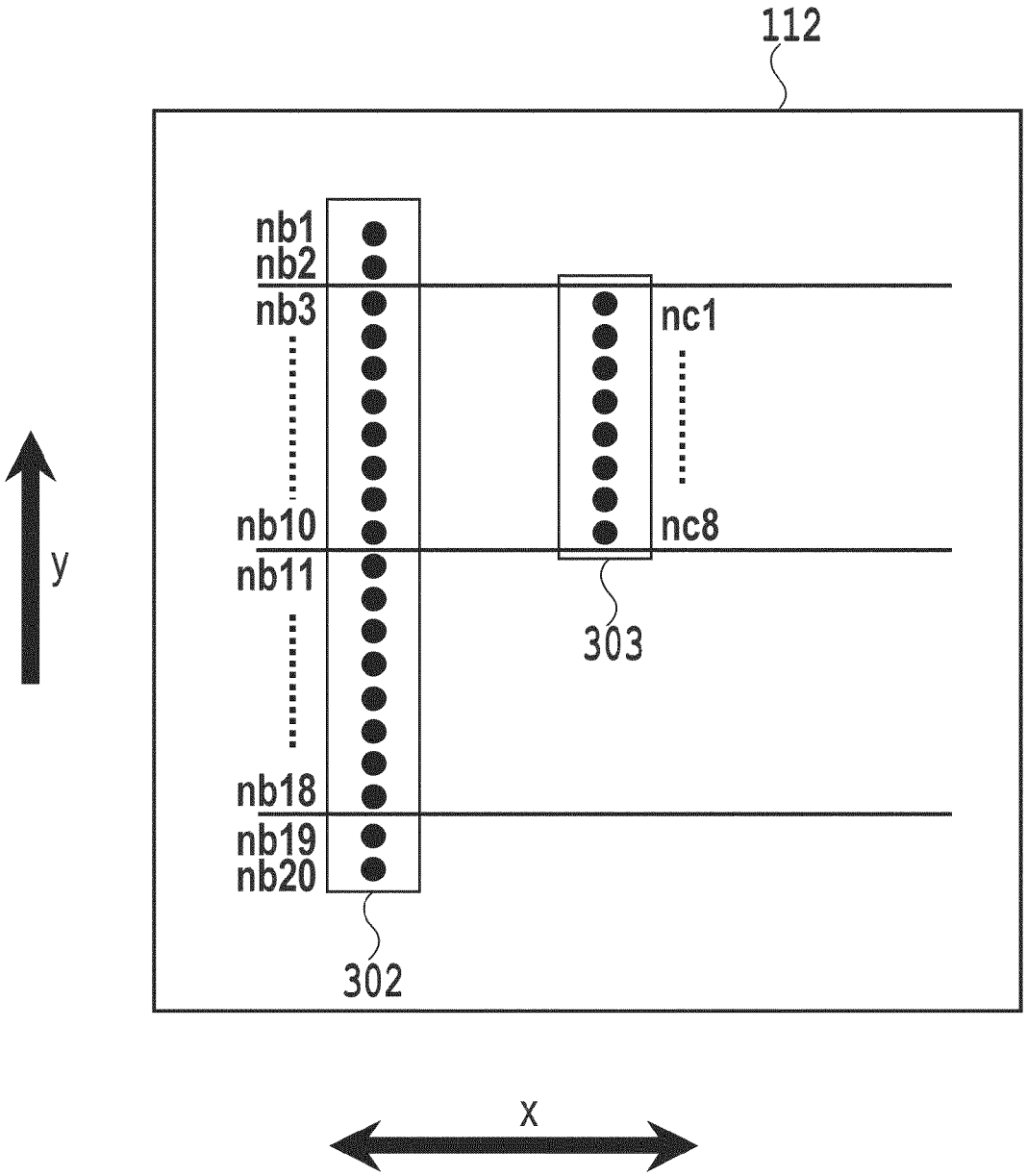
FIG. 3 is a diagram showing a nozzle construction of a print head according to the present invention.

FIG. 3 is a diagram showing a structure of nozzle arrays equipped in the print head 112.

A black nozzle array 302 (first nozzle array) and a cyan nozzle array 303 (second nozzle array) are arranged in a scanning direction (x direction in the figure) in the print head 112. It should be noted that a yellow nozzle array and a magenta nozzle array are also provided as color nozzle arrays in the print head, but herein, for simplifying an explanation of the following printing position adjustment or the like, there will be made an explanation of the printing position adjustment in a case of the black nozzle array and the cyan nozzle array and printing control relating to it.

The black nozzle array 302 is formed of twenty nozzles nb1 to nb20 lined up in a sub-scanning direction (y direction in the figure) and the cyan nozzle array 303 is formed of eight nozzles nc1 to nc8 likewise lined up in the sub-scanning direction. The nozzles nb3 to nb10 in the black nozzle array and the nozzles nc1 to nc8 in the cyan nozzle array are lined up to be respectively located in the same position to each other in the sub-scanning direction, assuming that there is no displacement with each other between the nozzle arrays. More specifically, the nozzles in a part of the black nozzle array are located in such positions as to overlap with the nozzles in the cyan nozzle array when seen from the scanning direction. As shown in FIG. 3, the plurality of the nozzle arrays in the present embodiment are constructed on a united print head, but are not limited to this configuration without mentioning. For example, the plurality of the nozzle arrays are respectively constructed on individual print heads. A displacement possibly occurring between the nozzle arrays in this case is caused by, for example, a mount position displacement of each of the print heads or the like.

In the present embodiment, printing an image is performed in a color mode which performs printing using both the black nozzle array 302 and the cyan nozzle array 303 or a monochrome mode which performs printing using only the black nozzle array 302, depending on printing conditions such as print data or the like. More specifically, the printing control section 106 switches between the monochrome mode as a first mode and the color mode as a second mode depending on the printing conditions such as print data or the like.

In the color mode, the printing operation is performed by using the nozzles nb3 to nb10 in the black nozzle array and the nozzles nc1 to nc8 in the cyan nozzle array. That is, both of the black nozzle array and the cyan nozzle array use the nozzles in the same positions with each other in the sub-scanning direction. In a case of this nozzle arrangement, since the black nozzle array and the color (cyan) nozzle array are not formed to be lined up long in the sub-scanning direction, this arrangement can contribute to downsizing of the print head, that is, downsizing of the printing apparatus.

The present invention is not limited to the aforementioned example, but in a case of performing a printing operation using both of the black nozzle array 302 and the cyan nozzle array 303, a nozzle group composed of the nozzles nb11 to nb18 in the black nozzle array and a nozzle group composed of the nozzles nc1 to nc8 in the cyan nozzle array may be used. That is, the print head 112 scans a given area on the printing medium, and therefore, an image in black ink is printed by means of the black nozzle group (nozzles nb11 to nb18). Thereafter, the printing medium is conveyed by a width of the above given area in the sub-scanning direction y, and an image with cyan ink is printed in the above given area by means of the cyan nozzle group (nozzles nc1 to nc8). According to such a printing method, as described above, the time from a point after the black ink is applied to the printing medium to a point the cyan ink is applied to the printing medium can be sufficiently secured to reduce the ink bleeding into each other between the black ink and the cyan ink.

On the other hand, in the monochrome mode which performs a printing operation by using only the black nozzle array 302, an image is printed by the black nozzle group (nb1 to nb20) having a long nozzle arrangement length, making it possible to realize the high-speed image printing.

Next, a method of adjusting a displacement of the printing position between the black nozzle array and the cyan nozzle array in the sub-scanning direction will be explained. At the time of adjusting the displacement of the printing position in the sub-scanning direction, first, a test pattern is printed on the printing medium and an adjustment value for adjusting the position displacement is obtained based on density information (optical density information) of the test pattern. Then, use ranges of the nozzles in the black nozzle array and the cyan nozzle array are changed relative to each other based upon the adjustment value and the printing operation is performed using the nozzles in the changed use range.

Figure 4:
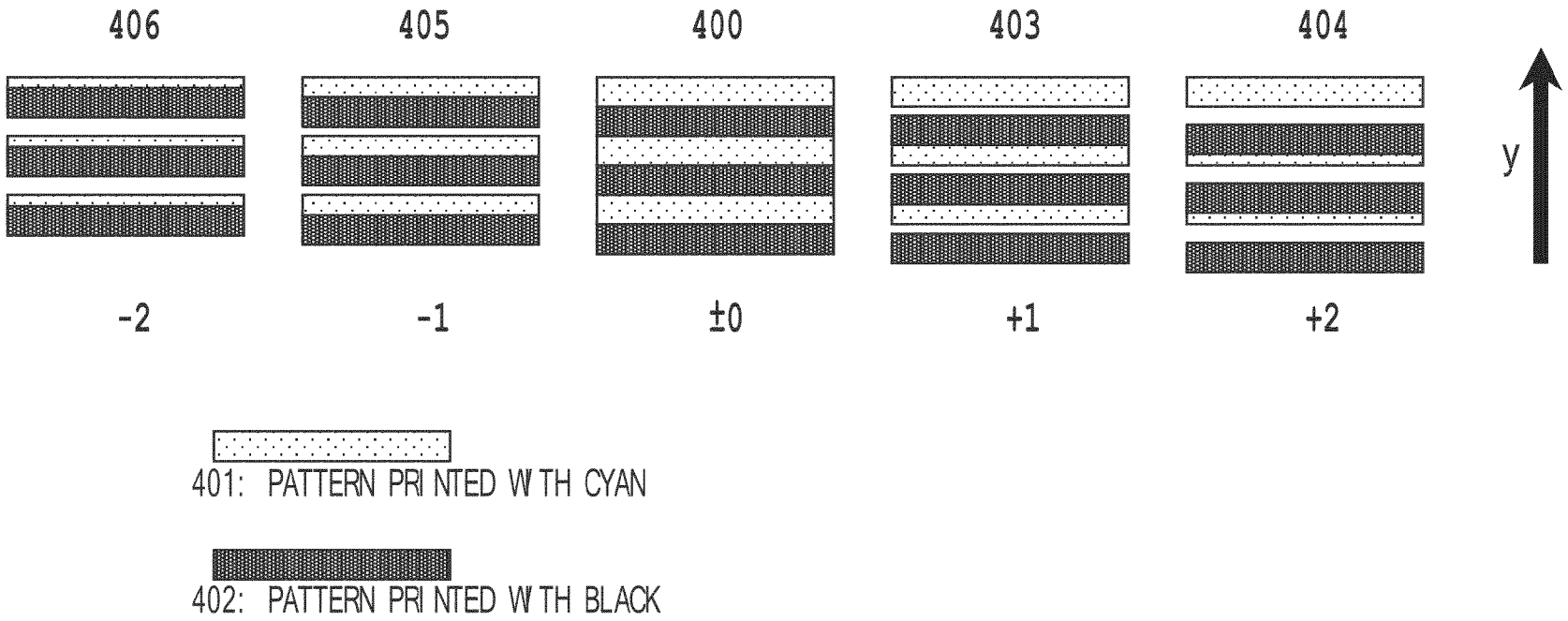
FIG. 4 is a diagram showing a plurality of test patterns of a printing position adjustment according to the present invention.

FIG. 4 is diagram showing a test pattern for adjusting the displacement of the printing position in the sub-scanning direction.

This test pattern is composed of a plurality of patterns in each of which a printing operation is performed by displacing a pattern 402 printed by the black nozzle array 302 by a predetermined amount in the sub-scanning direction relative to a pattern 401 printed by the cyan nozzle array 303. That is, there are printed a plurality of patterns in which displacement amounts in the sub-scanning direction between the pattern 401 of cyan and the pattern 402 of black are different from each other. In the following explanation, in both of the pattern 401 of cyan and the pattern 402 of black, a size of each pattern in the sub-scanning direction is explained as a one-dot dimension printed by one nozzle, but the size of each pattern in the sub-scanning direction may be several dots (for example, four dots).

In an example as shown in FIG. 4, a pattern 400 in which the displacement amount between the cyan pattern 401 and the black pattern 402 in the sub-scanning direction is made to be zero is printed and four patterns 406, 405, 403 and 404 in each of which the displacement amount between the cyan pattern 401 and the black pattern 402 in the sub-scanning direction is different from each other are printed. Specially a range of the use nozzle in the black nozzle array is displaced by one nozzle relative to the cyan pattern 401 as a reference, thereby printing the pattern 403 in which the black pattern 402 is displaced by +1 in the sub-scanning direction relative to the cyan pattern 401 and the pattern 404 in which the black pattern 402 is displaced by +2 in the sub-scanning direction relative to the cyan pattern 401. In reverse, the pattern 405 in which the black pattern 402 is displaced by −1 in the sub-scanning direction to the cyan pattern 401 and the pattern 406 in which the black pattern 402 is displaced by −2 in the sub-scanning direction relative to the cyan pattern 401 are printed.

In the present embodiment, in a case where the print position displacement in the sub-scanning direction between the cyan nozzle array and the black nozzle array does not exist, the patterns of cyan and the patterns of black are printed to be lined up alternately in the sub-scanning direction without a clearance between the pattern of cyan and the pattern of black in a pattern with the displacement amount of ±0, and this pattern has the highest density among the five patterns.

Here, when the displacement amount of the pattern is explained, a case of displacing the black pattern relative to the cyan pattern as a reference at the downstream side in the sub-scanning direction (upper direction in the figure) is expressed with "−". On the other hand, a case of displacing the black pattern to the cyan pattern as a reference at the upstream side in the sub-scanning direction (lower direction in the figure) is expressed with "+". In the present embodiment, the nozzles are lined up in a pitch of 600 dpi in each of the black nozzle array and the cyan nozzle array, and the black pattern can be printed to be displaced by a unit of 600 dpi relative to the cyan pattern. Therefore, for example, the displacement amount expressed with "−1" shows that the black pattern is printed to be displaced to the downstream side by 1/600 inches relative to the cyan pattern as a reference. That is, the pattern 405 having the displacement amount of "−1" is printed by displacing the use nozzle in the black nozzle array by one nozzle to the downstream side.

It should be noted that, instead of displacing the use nozzle as described above, the pattern can be printed in such a manner that the cyan pattern 401 and the black pattern 402 are displaced by a predetermined amount in the sub-scanning direction by interposing a fine conveying of the printing medium between printing of the cyan pattern 401 and the black pattern 402.

Figure 5:
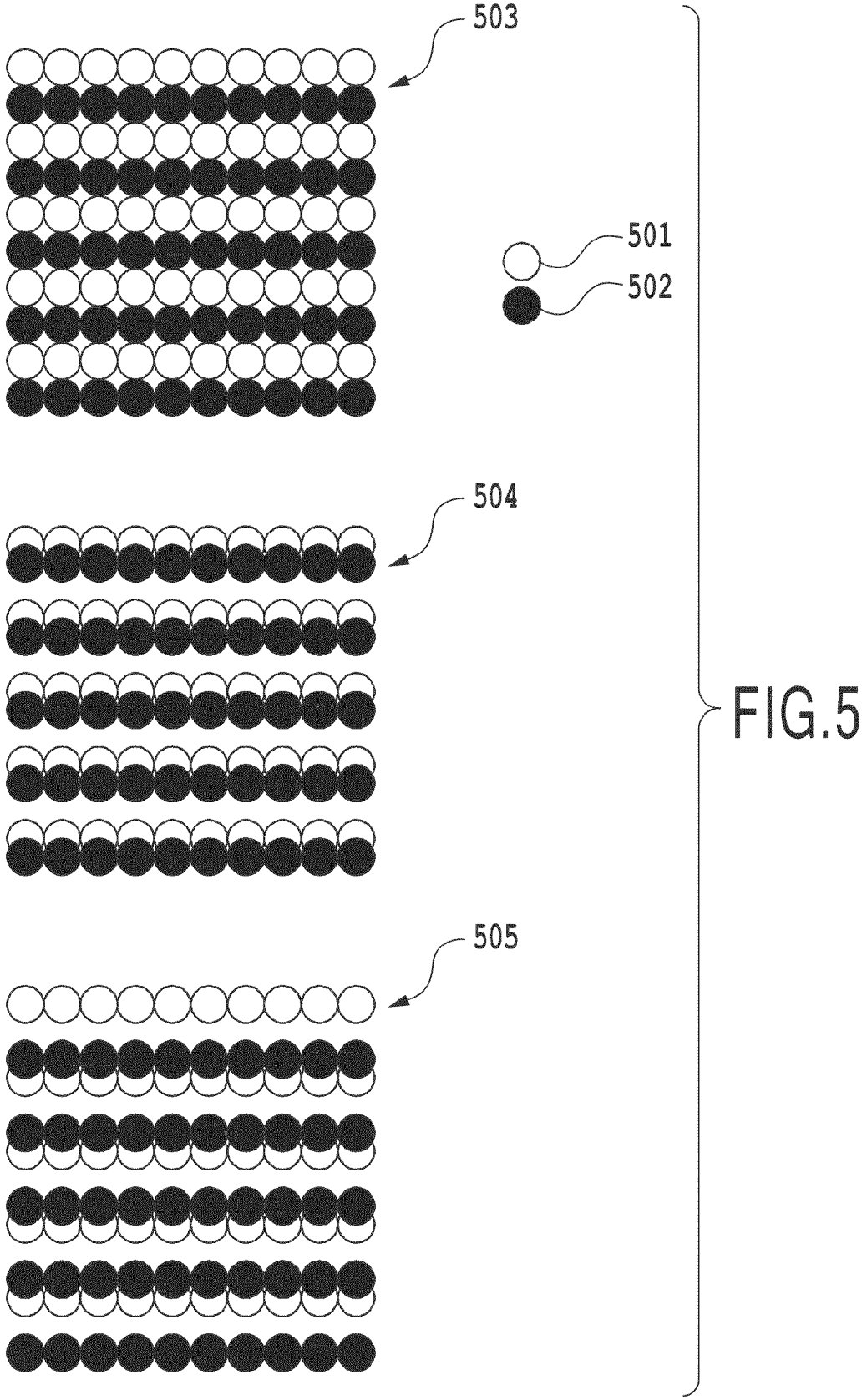
FIG. 5 is a diagram showing a plurality of dot arrangements of the printing position adjustment according to the present invention.

FIG. 5 is diagram showing dot arrangement in each of several patterns shown in FIG. 4.

A dot arrangement 503 shows a dot arrangement of the pattern 400 printed with the displacement amount of ±0 when the displacement of the printing position in the sub-scanning direction does not exist. In this case, cyan dots 501 and black dots 502 are not displaced with each other and printed in positions so as not to overlap. Therefore, since the rate of dots covering the printing medium (covering average) is the highest in this pattern among the five patterns, the print density of the pattern is the highest.

Dot arrangements 504 and 505 respectively show a dot arrangement of the pattern 405 with the displacement amount of "−1" and a dot arrangement of the pattern 403 with the displacement amount of "+1" relative to the pattern printed when the displacement of the printing position between the nozzle arrays in the sub-scanning direction does not exist. The dot arrangement 504 is a pattern printed by displacing the black pattern 402 to the downstream side in the sub-scanning direction by 1/600 inches relative to the cyan pattern 401, wherein the cyan dot 501 and the black dot 502 overlap so that a portion of a white background of the printing medium appears and the print density is lower than in the pattern 503. The dot arrangement 505 is a pattern printed by displacing the black pattern 402 to the upstream side in the sub-scanning direction by 1/600 inches relative to the cyan pattern 401. In this pattern also, the cyan dot 501 and the black dot 502 overlap so that a portion of a white background of the printing medium appears and the print density is lower than in the pattern 503.

As described above, the print density of the pattern changes in accordance with the position relation in the sub-scanning direction between the cyan dot and the black dot. That is, in a case where the print position displacement exists between the black nozzle array and the cyan nozzle array, the pattern for which the print density to be measured is the highest changes in accordance with the displacement amount. Therefore, by selecting the pattern with the highest print density out of the five patterns by means of the sensor 109, the print position displacement at this time can be detected. An adjustment value for adjusting the displacement of the printing position in the sub-scanning direction can be obtained based upon the detected print position displacement.

For example, in a case where it is detected that the print density of the pattern 400 printed with displacement amount of ±0 is the highest, the cyan dot and the black dot are supposed to be printed in ideal positions. Therefore, it is determined that the displacement of the printing position does not exist between the black nozzle array and the cyan nozzle array, making it possible to obtain ±0 as the adjustment value. In this case, at the time of performing a printing operation using both of the black nozzle array and the cyan nozzle array, the black nozzles nb3 to nb10 and the cyan nozzles nc1 to nc8 shown in FIG. 3 are used.

For example, in a case where it is detected that the print density of the pattern 403 printed with displacement amount of +1 is the highest, it is determined that the printing position of the black nozzle array is displaced to the downstream side in the sub-scanning direction by 1/600 inches relative to the printing position by the cyan nozzle array, and the adjustment value at this time is obtained as +1 (as explained next, the adjustment is the adjustment (shift) to the upstream side).

In the case where the adjustment value is +1 as the above, the use range of the nozzles in the black nozzle array is shifted to the upstream side by 1/600inches, that is, by one nozzle in such a manner as to cancel the displacement (+1) of the printing position in the black nozzle array relative to the printing position by the cyan nozzle array. Specifically, the nozzles nb4 to nb11 are determined to be the use nozzles in the black nozzle array and the nozzles nc1 to nc8 are determined to be the use nozzles in the cyan nozzle array.

The following explanation is made in relation to an example where the displacement amount of the printing position of the black nozzle array relative to the printing position of the cyan nozzle array is +1, that is, the adjustment value is +1. That is, as a result of the adjustment of the printing position, the area to be printed with the black ink and the cyan ink is printed by using the black nozzles nb4 to nb11 and the cyan nozzles nc1 to nc8.

The density detection of the test patter is not limited to the configuration using the sensor 109, but a pattern having the highest density may be detected by a visual observation by a user. Further, by selecting a pattern having the lowest density supposing that a case where the pattern of black and the pattern of cyan completely overlap is a case of an ideal position of the pattern (displacement amount of ±0), the displacement amount of the printing position may be adjusted. As apparent from the above explanation, since the adjustment value of the printing position and the displacement amount of the printing position have a relationship that the values are equal with each other and the directions are just the opposite, the adjustment value and the displacement amount may be handled substantially in the same way. Therefore, in the present specification, this may be described as an adjustment value (displacement amount) and the like.

Figure 6:
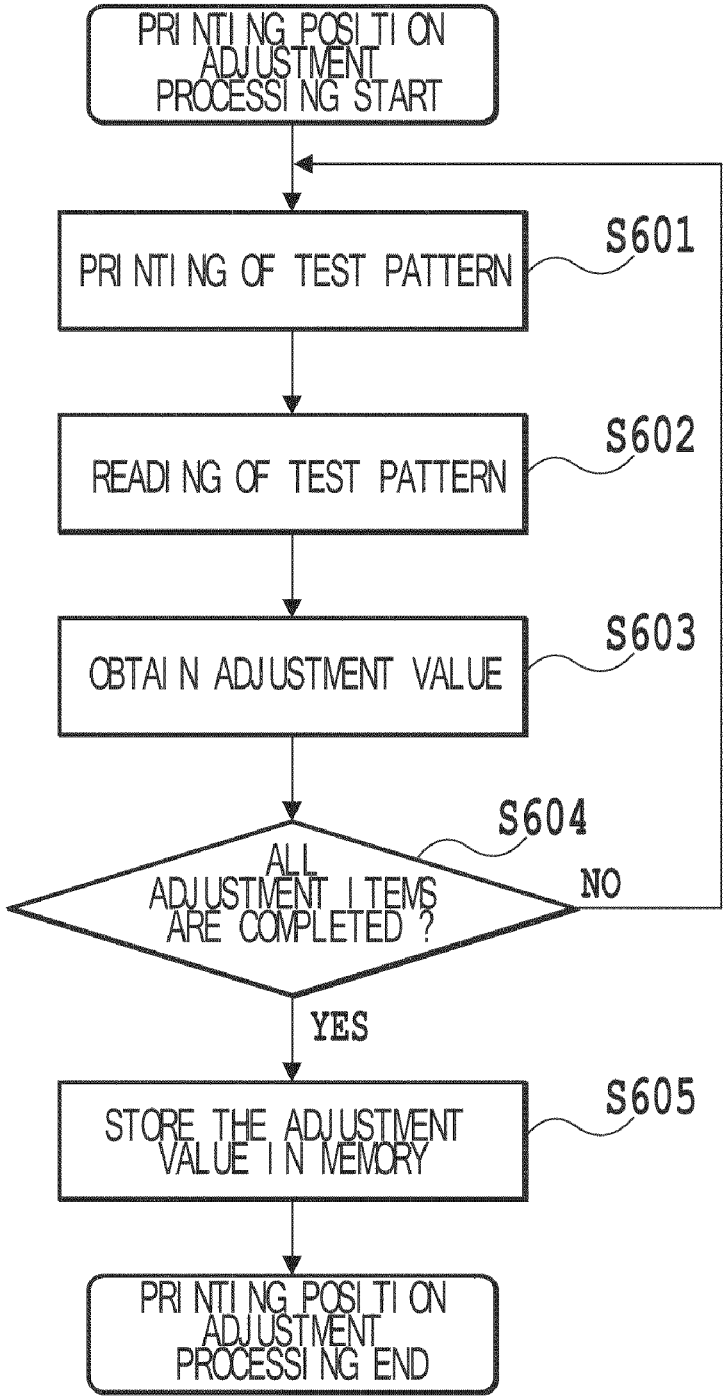
FIG. 6 is a flow chart showing a printing position adjustment process according to the present invention.

FIG. 6 is a flow chart showing a printing position adjusting process of the present embodiment.

When the printing position adjusting process is started, at step S601 a test pattern for adjusting a printing position is printed. Next, at step S602, the printed test pattern is read by the sensor 109, and an adjustment value is obtained from the read result (S603). Then at step S604, a determination on whether or not adjustment values of all items are obtained is made. When the adjustment values of all the items are obtained, the adjustment values are stored in a memory (S605) and the present process ends. On the other hand, when obtaining all the adjustment items is not completed, the process subsequent to the printing of the test pattern is repeated to continue to obtain the adjustment value. By performing the above process, various printing position adjustments such as the printing position adjustment in the main scan direction between the nozzle arrays can be simultaneously performed in addition to the printing position adjustment in the sub-scanning direction described above.

Figure 7A:
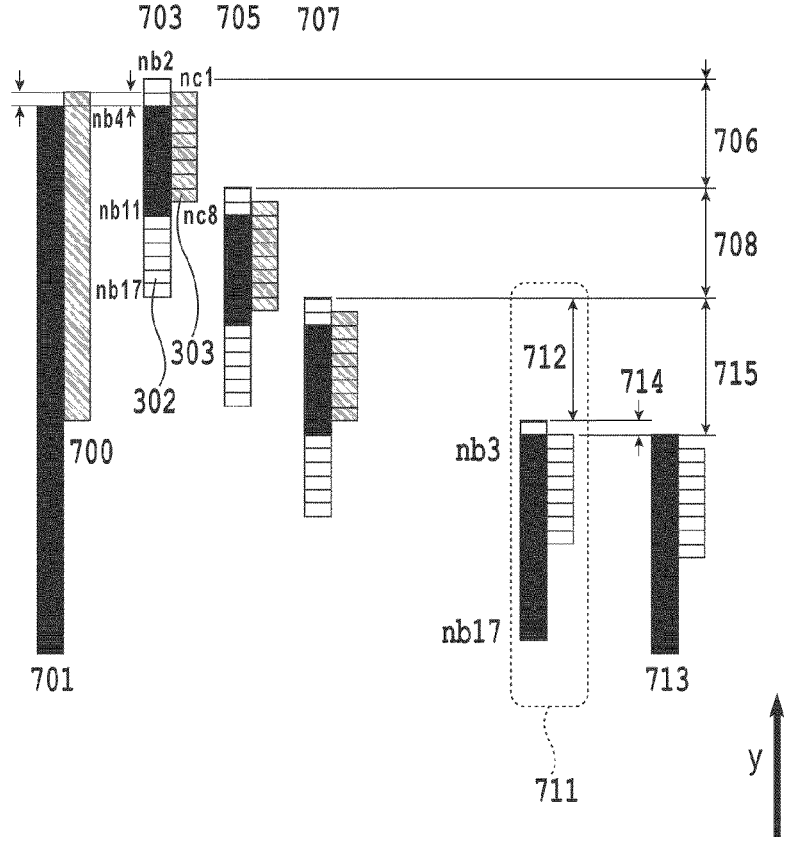
FIGS. 7A and 7B are diagrams each explaining a conveying amount control at the time of changing a nozzle array in use.
Figure 7B:
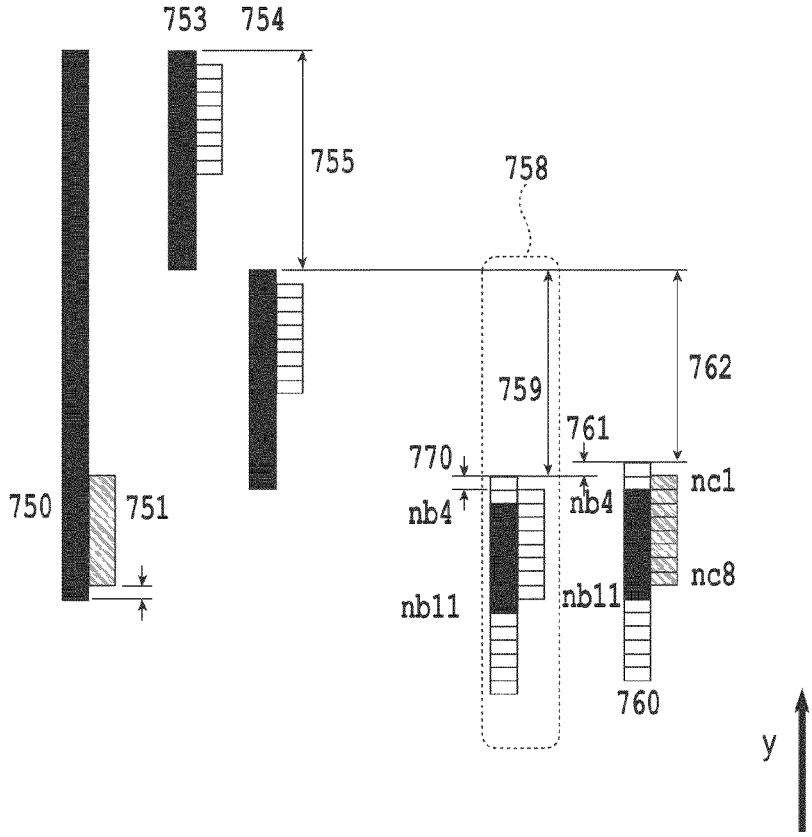

FIGS. 7A and 7B are diagrams explaining control at the time of switching between the monochrome mode that uses only the black nozzle array and the color mode that uses both of the black nozzle array and the cyan nozzle array, in the image printing according to the embodiment in the present invention.

FIG. 7A shows the control at the time of transferring from the color mode of using both of the black nozzle array and the cyan nozzle array into the monochrome mode of using only the black nozzle array.

In this figure, reference numeral 302 denotes the black nozzle array and reference numeral 303 denotes the cyan nozzle array, wherein in each array, one section corresponds to one nozzle. In FIG. 3, the black nozzle array is explained as the nozzle array having 20 nozzles, but herein, only 16 nozzles formed of the nozzles nb2 to nb17 are shown in the figure for explanation. Reference numerals 703, 705, 707, and 713 denote states of four times of scans by the print head and the scan 703 is the first scan.

Further, reference numeral 701 denotes a range in the sub-scanning direction of the image data printed with use of the black nozzle array 302, and reference numeral 700 denotes a range in the sub-scanning direction of the image data printed with use of the cyan nozzle array 303. The black image data and the cyan image data are shown to correspond to the respective areas in the sub-scanning direction managed in the memory of the printing apparatus. More specifically, in accordance with the print position displacement of +1 described above, the black image data is managed to be shifted by one nozzle at the upstream side in the sub-scanning direction relative to the cyan image data, in the memory of the printing apparatus.

In the present example, since the printing position of the black nozzle array is displaced by one nozzle (+1) to the downstream side in the sub-scanning direction relative to the printing position of the cyan nozzle array, the nozzles used for printing in the black nozzle array are the nozzles nb4 to nb11 in positions displaced in the sub-scanning direction relative to the cyan nozzle array.

Therefore, the data corresponding to 8 nozzles from the upper position in the black image data are printed by the nozzles nb4 to nb11, and the data corresponding to 8 nozzles from the upper position in the cyan image data are printed by the nozzles nc1 to nc8. The data of each of the cyan and the black is printed in the same position in the sub-scanning direction on the actual printing medium.

When the first printing scan 703 is completed, the printing medium is conveyed by an 8-nozzle pitch (706), and a black image and a cyan image are printed at the next area by the second printing scan 705. Here also, for adjusting the displacement amount of "+1" between the printing position by the black nozzle array and the printing position by the cyan nozzle array, the black nozzles nb4 to nb11 are used. When the second printing scan 705 is completed, the printing medium is conveyed by an 8-nozzle pitch (708) and in the same way, the third printing scan 707 is performed.

By the three times of the scans as described above, the image data 700 of cyan all are printed. In the fourth scan 713 or later, the image of a single black color is printed.

When printing the image of the single black color, a conventional printing operation maintains the adjustment of the printing position between the nozzles as it is so that the displacement is not produced between the area where the image of black and the image of cyan printed as described above exist in a mixing way and the area of the image of black only printed thereafter. That is, since in the black nozzle array, the print position displacement corresponding to one nozzle is produced at the downstream side in the sub-scanning direction, also at the time of printing the image of the single black color, a range shifted by one nozzle to the upstream side relative to the entire use range of the nozzles is defined as the use range, and the conveying amount control corresponding to the use range is performed. Specially, as shown in a printing scan 711, 15 nozzles nb3 to nb17 shifted by one nozzle at the upstream side relative to all the nozzles in the black nozzle array are used. The conveying amount 712 of transfer is defined as a conveying amount (corresponding to nine nozzles) matching the above use range.

By this printing position adjustment and this conveying amount control, the image of the single black color can be printed without an influence of the print position displacement of the black nozzle array which is the displacement corresponding to one nozzle at the downstream side, but as a result, not all the nozzles of the black nozzle array are used. Therefore, there is a possibility that high-speed printing at the time of performing a printing operation using the black nozzle array having a relatively long nozzle arrangement length can not be sufficiently realized. For example, in case of FIG. 7A, a relatively large number of printing scans (that is, further fifth scan) are required for print completion of the black image 701.

In contrast, in the present embodiment, at the time of printing the image of the single black color, all the nozzles nb2 to nb17 in the black nozzle array are use and also the conveyance of a conveying amount 715 is performed in consideration of the displacement of the printing position of the black nozzle array. Specially as shown in the printing scan 713, 16 nozzles composed of all the nozzles nb2 to nb17 in the black nozzle array are used. In this case, unless any adjustment is made, a displacement corresponding to the adjustment value of the print position displacement is produced between the image area printed in the scans 703, 705, and 707 where the black and the cyan exist in a mixing way and the image area of only the black. Therefore, by reflecting the displacement amount of the printing position of the black nozzle array to the conveying amount, the conveying amount 715 (amount 712+ amount 714) is controlled to correspond to a 10-nozzle pitch.

By the printing position adjustment and the conveying amount control as described above, even in a case where the displacement of the printing position of the black nozzle array relative to the cyan nozzle array occurs, the image area of the single black color using all the nozzles in the black nozzle array can be printed without an influence of the print position displacement of the black nozzle array.

In reverse to the above example, in a case where the displacement of the printing position of the black nozzle array corresponding to one nozzle pitch is produced at the upstream side in the sub-scanning direction, by reflecting the displacement amount of the printing position of the black nozzle array to the conveying amount, the conveying amount at the time of changing into a state of performing a printing operation with the black nozzle array alone is made to an 8-nozzle pitch.

Here, the conveying amount control according to the present embodiment at the time of changing the color mode as the second mode into the monochrome mode as the first mode can be generalized as follows. Specifically, in the case of the black nozzle array being displaced by a predetermined amount (corresponding to one nozzle) to the downstream side in the sub-scanning direction relative to the cyan nozzle array, the predetermined amount (corresponding one nozzle) is added to a conveying amount. On the other hand, in the case of the black nozzle array being displaced by a predetermined amount (corresponding one nozzle) to the upstream side in the sub-scanning direction relative to the cyan nozzle array, the predetermined amount (corresponding one nozzle) is subtracted from the conveying amount.

FIG. 7B is a diagram explaining the control at the time of transferring from the monochrome mode into the color mode.

This figure corresponds to FIG. 7A and shows states of three times of scans 753, 754, 760 of the print head. Reference numeral 750 denotes a range in the sub-scanning direction of the image data printed by the black nozzle array, and reference numeral 751 shows a range in the sub-scanning direction of the image data printed by the cyan nozzle array. In the same way as in FIG. 7A, in accordance with the print position displacement of +1, in regard to the black image data and the color image data, the black image data is managed to be shifted by one nozzle at the upstream side in the sub-scanning direction relative to the cyan image data in the memory of the printing apparatus. That is, the printing position of the black nozzle array is displaced by one nozzle to the downstream side in the sub-scanning direction, and the black image data and the color image data are printed so that the respective lower ends are aligned on the actual printing medium.

As shown in FIG. 7B, all the nozzles in the black nozzle array are used in the first printing scan 753 and in the second printing scan 754 to perform a printing operation, and the conveyance 755 corresponding to an entire length of the black nozzle array is carried out between the printing scan 753 and the printing scan 754. In the third scan or later, the state of using only the black nozzle array changes into the state of using both of the black nozzle array and the cyan nozzle array, wherein printing of an area where the image of black and the image of cyan exist in a mixing way is performed.

The black nozzle array has the print position displacement corresponding to one nozzle to the downstream side in the sub-scanning direction, but in the first and second printing scans, the adjustment value of the print position displacement is not reflected in the black nozzle array to perform a printing operation using all the nozzles. However, in the third scan, for performing the printing operation using both of the black nozzle array and the cyan nozzle array, the adjustment value of +1 for the black nozzle array relative to the cyan nozzle array is reflected.

If the printing medium conveyance is performed without reflecting the adjustment value of the black nozzle array between the second scan and the third scan (758), it results in the conveyance (corresponding to a 15-nozzle pitch) as shown in a conveying amount 759. That is, in a case of considering only the conveying amount 759 to the boundary between the image area of black only printed in the first and second scans and the image area where the image of black and the image of cyan printed after the third scan exist in a mixing way and of not considering the adjustment value of the black nozzle array, the conveying amount 759 corresponds to 15 nozzle pitches. When the use range used in the black nozzle array for adjusting the print position displacement with the adjustment value of +1 is set to nozzles nb4 to nb11 in the third scan, as shown in the scan 758, a clearance 770 where the printing is not performed is produced between the image area of black only and the image area where the image of black and the image of cyan exist in a mixing way.

In contrast, according to the present embodiment, the control is performed so that the adjustment value of the printing position is reflected to the black nozzle array in the third printing scan, and also the adjustment value (displacement value) of the printing position is reflected to the conveyance amount of the printing medium between the second scan and the third scan (760) to make the conveying amount 762 (amount 759-amount 761) equal to 14 nozzles.

By the printing position adjustment and the conveying amount control as described above, even in a case of changing into the state performing the printing operation using both of the black nozzle array and the color nozzle array, it is possible to print the image using the black nozzle array and the cyan nozzle array without an influence of the print position displacement of the black nozzle array.

On the contrary to the above example, in the case that the displacement of the printing position of the black nozzle array occurs by one nozzle to the upstream side in the sub-scanning direction, the adjustment value (displacement amount) is reflected to the conveying amount to correspond to 16 nozzles.

Here, the conveying amount control according to the present embodiment at the time of changing the monochrome mode as the first mode into the color mode as the second mode can be generalized as follows. Specifically, in the case of the black nozzle array being displaced by a predetermined amount (corresponding to one nozzle) to the downstream side in the sub-scanning direction relative to the cyan nozzle array, the predetermined amount (corresponding one nozzle) is subtracted from the conveying amount. On the other hand, in the case of the black nozzle array being displaced by a predetermined amount (corresponding one nozzle) to the upstream side in the sub-scanning direction relative to the cyan nozzle array, the predetermined amount (corresponding one nozzle) is added from the conveying amount.

Figure 8:
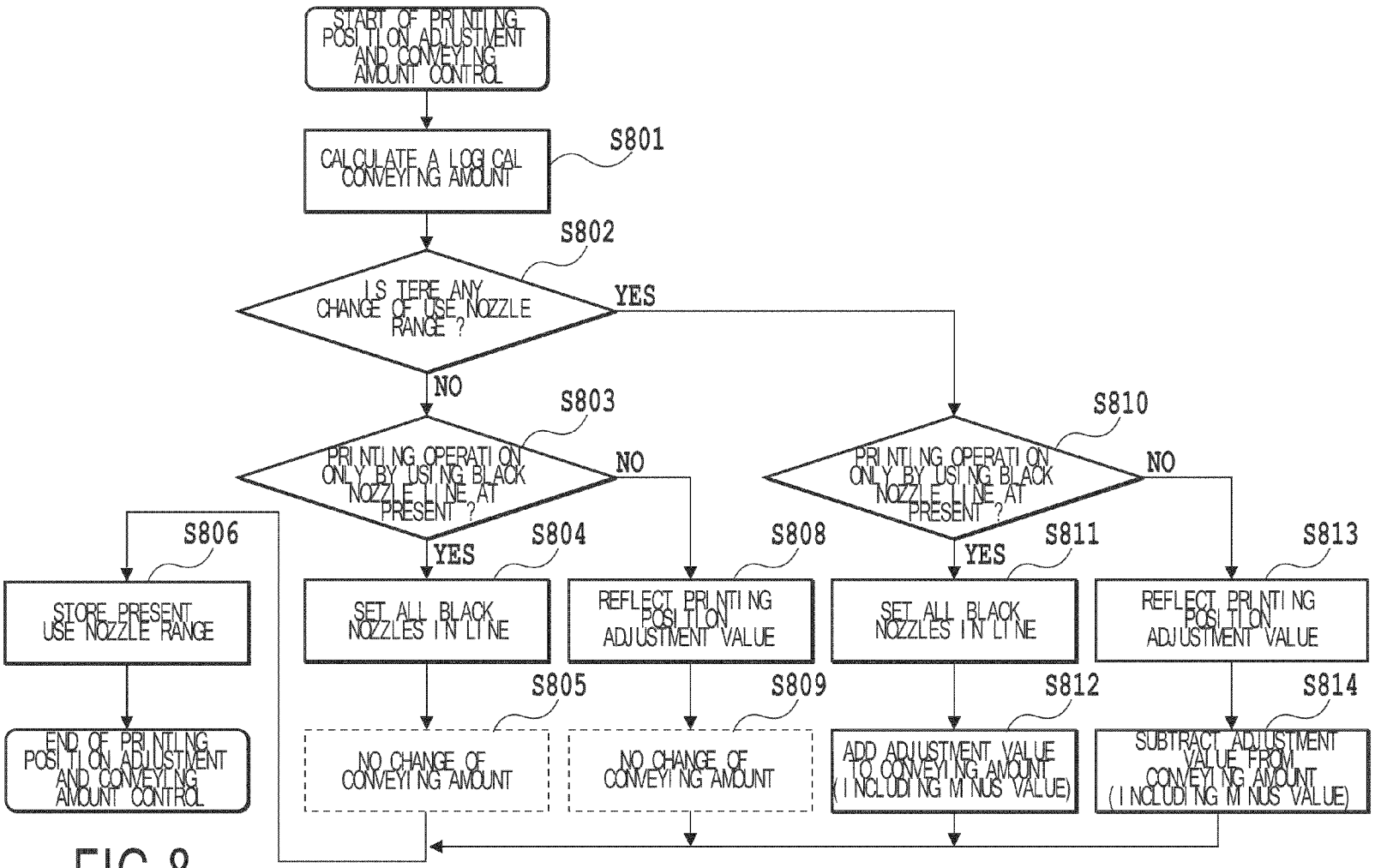
FIG. 8 is a flow chart showing control according to the embodiment of the present invention.

FIG. 8 is a flow chart showing the printing position adjustment and the conveying amount control explained in FIGS. 7A and 7B.

When the printing position adjustment and the conveying amount control are started, first, at step S801 the conveying amount is calculated. Here, in a case of performing a printing operation using both of the black nozzle array and the cyan nozzle array at the time, the conveying amount is calculated as a conveying amount to which the printing position adjustment value is reflected. On the other hand, in a case of using the black nozzle array only, the conveying amount is calculated not considering the printing position adjustment value of the black nozzle array for enabling the printing using an entire region of the black nozzle array.

Next, at step S802 it is checked whether or not there is a difference between the previous use nozzle range and the current use nozzle range to determine whether or not the use nozzle range changes. In a case where it is determined at this step that the use nozzle range has no change, the process goes to step S803, wherein it is determined whether or not the present printing operation is a printing operation using the black nozzle array only. Here, in a case of the affirmative judgment, at step S804 the nozzle range to be used is set as an entire black nozzle array. Further, the conveying amount is set as the same one as the conveying amount calculated at step S801 (S805).

On the other hand, in a case where the negative judgment is made in the determination on whether or not the present printing operation uses the black nozzle array only (S803), the process goes to step S808, wherein the use nozzle range of the nozzles in the black nozzle array is changed by reflecting the printing position adjustment value to the black nozzle array to perform the printing position adjustment. Further, the conveying amount is set as the same one as the conveying amount calculated at step S801 (S809).

In a case where at step S802 it is determined that there is a difference between the previous use nozzle range and the current use nozzle range, the process goes to step S810, wherein it is determined whether or not the present printing operation is a printing operation using the black nozzle array only. Here, in a case of the affirmative judgment, the use nozzle range in the black nozzle array is set as an entire black nozzle array (S811). Next, at step S812, the printing position adjustment value (displacement amount) of the black nozzle array is reflected (added) to the conveying amount with the change of the use nozzle array.

On the other hand, in a case where the negative judgment is made in the judgment result at step S810, at step S813 the printing position adjustment value is processed to be reflected in the black nozzle array. Next, at step S814, the printing position adjustment value (displacement amount) of the black nozzle array is processed to be reflected (subtracted from) to the conveying amount with the change of the use nozzle array.

Finally, the process for storing the present use nozzle range (S806) is performed to complete the printing position adjustment and the conveying amount control.

Figure 9:
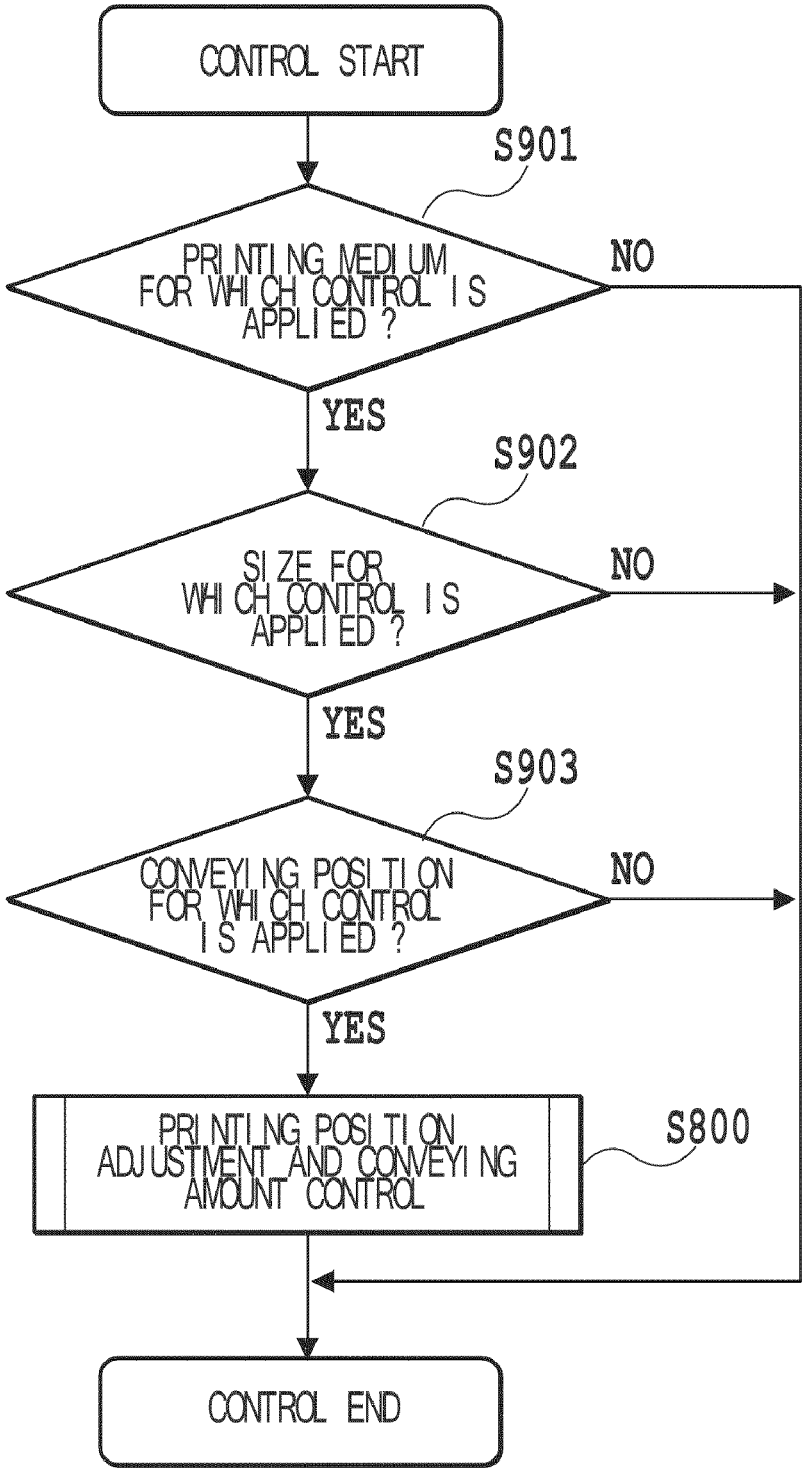
FIG. 9 is a flow chart showing the other control according to the embodiment of the present invention.

FIG. 9 is a flow chart showing the other control process according to the embodiment of the present invention.

The control flow shown in FIG. 9 is the control for determining a condition for performing the printing position adjustment and the conveying amount control explained in FIG. 8.

When the control of FIG. 9 is started, at step S901 it is determined whether or not a type of medium is a printing medium intended for application of the control shown in FIG. 8. In a case where this determination is the affirmative judgment, the process goes to step S902, wherein it is determined whether or not the printing medium has a size intended for application of the control shown in FIG. 8. In a case where this determination is also the affirmative judgment, the process goes to step S903, wherein it is determined whether or not the printing medium is in a conveying position intended for application of the control shown in FIG. 8. In a case where the above three determinations all are met (positive judgments), the printing position adjustment and the conveying amount control shown in FIG. 8 are performed and the entire control is completed. In a case where any of the above three determinations is a negative judgment, the control completes without performing the printing position adjustment and the conveying amount control.

In the ink jet printing apparatus using the conveying roller and the sheet discharging roller, front end and rear end areas of the printing medium are in a state of being conveyed by any of the two rollers, deteriorating the conveying accuracy. Therefore, there is conventionally known a technology where at the time of printing on the front end area or the rear end area of the printing medium, the use range of the nozzle array is limited to reduce an error of the conveying amount. Therefore, also in the present embodiment, in a case where it is not appropriate to use the entire region of the black nozzle array due to the position in the sub-scanning direction as in the control explained in FIG. 9, the control explained in FIG. 8 is configured not to be performed. Thereby, it is possible to maintain the accuracy of the conveying amount. Since the carrier accuracy at the time of carrying the medium by any of the rollers differs depending on a size or a kind of the printing medium, the aforementioned determination control is performed.

As described above, the control of the conveying amount according to the present embodiment changes the conveying amount at the time of switching between the monochrome mode that uses the black nozzle array only and the color mode that performs printing where the relative position is adjusted between the black nozzle array and the color nozzle array, in accordance with the printing position displacement between the black nozzle array and the color nozzle array. That is, in a case that the printing position adjustment is performed in one mode of the two modes, the conveying amount is changed according to the adjustment value (displacement amount). If the conveying amount is set without taking into account the adjustment value (displacement amount), problems such as occurring of blank spaces which is not subjected to printing, producing nozzles not used for printing or the like occurs, as described above. The present invention resolves such problems.

Accordingly, the present invention can be widely applied to embodiments which perform printing in a first mode that uses a first nozzle array or a second mode that uses the first nozzle array and a second nozzle array and performs a printing position adjustment between the first and second nozzle arrays. Therefore, the present invention is not limited to an arrangement in which the length of a black nozzle array is longer than the length of a color nozzle array, and is also applied to an arrangement in which a black nozzle array and color nozzle array have the same length. Further, in the first mode which uses the first nozzle array only, all the nozzles in the first nozzle array is not always used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-206192, filed Aug. 8, 2008, which is hereby incorporated by reference herein in its entirety.

What is claimed is:

1. A printing apparatus comprising:

a printing unit having a first nozzle array and a second nozzle array which respectively arrange a plurality of nozzles in a predetermined direction;

a conveying unit for conveying a print medium in the predetermined direction; and a control unit for controlling said printing unit and said conveying unit to print an image on the print medium, wherein said control unit is configured to perform a first mode, where the first nozzle array is used for printing, and a second mode, where the first and second nozzle arrays are used for printing, and said control unit changes use nozzles in the first nozzle array in accordance with a relative print position displacement in the predetermined direction between the first and second nozzle arrays when performing the second mode, and changes a conveying amount of the print medium, where conveyance is performed between the first mode and the second mode, in accordance with the relative print position displacement.

2. A printing apparatus as claimed in claim 1, wherein a length of the first nozzle array in the predetermined direction is longer than a length of the second nozzle array in the predetermined direction.

3. A printing apparatus as claimed in claim 1, wherein said control unit uses all nozzles in the first nozzle array when performing the first mode.

4. A printing apparatus as claimed in claim 1, wherein said control unit controls said printing unit to print patterns for detecting the relative print position displacement.

5. A printing apparatus as claimed in claim 4, further comprising an optical measuring device for detecting density of the patterns.

6. A printing apparatus as claimed in claim 1, wherein said control unit, when changing from the second mode to the first mode, in a case where a printing position of the first nozzle array is displaced by a predetermined amount to a downstream side, in the predetermined direction relative to a printing position of the second nozzle array, adds the predetermined amount to the conveying amount, and in a case where a printing position of the first nozzle array is displaced by a predetermined amount to an upstream side, in the predetermined direction relative to a printing position of the second nozzle array, subtracts the predetermined amount from the conveying amount.

7. A printing apparatus as claimed in claim 1, wherein said control unit, when changing from the first mode to the second mode, in a case where a printing position of the first nozzle array is displaced by a predetermined amount to an upstream side, in the predetermined direction relative to a printing position of the second nozzle array, adds the predetermined amount to the conveying amount, and in a case where a printing position of the first nozzle array is displaced by a predetermined amount to a downstream side, in the predetermined direction relative to a printing position of the second nozzle array, subtracts the predetermined amount from the conveying amount.

8. A printing apparatus as claimed in claim 1, wherein said control unit does not change the conveying amount depending on a type of printing medium.

9. A printing apparatus as claimed in claim 1, wherein said control unit does not change the conveying amount depending on a conveying position of a printing medium in the predetermined direction.

10. A printing apparatus as claimed in claim 1, wherein said control unit does not change the conveying amount depending on a size of printing medium.

11. A printing method comprising:

a printing step of controlling a printing unit having a first nozzle array and a second nozzle array which respectively arrange a plurality of nozzles in a predetermined direction and a conveying unit for conveying a print medium in the predetermined direction to print an image on the print medium, wherein said printing step performs a first mode, where the first nozzle array is used for printing, and a second mode where the first and second nozzle arrays are used for printing, and said printing step changes use nozzles in the first nozzle array in accordance with a relative print position displacement in the predetermined direction between the first and second nozzle arrays when performing the second mode, and changes a conveying amount of the print medium, where conveyance is performed between the first mode and the second mode, in accordance with the relative print position displacement.

* * * * *